US005125932A

United States Patent [19]

Orth et al.

[11] Patent Number: 5,125,932

[45] Date of Patent: Jun. 30, 1992

[54] DISSOLUTION OF COAL WITH PETROLEUM PITCH

[75] Inventors: John C. Orth; Lloyd Berg, 1314 South Third Ave., both of Bozeman, Mont. 59715

[73] Assignee: Lloyd Berg, Bozeman, Mont.

[21] Appl. No.: 767,613

[22] Filed: Sep. 30, 1991

[51] Int. Cl.[5] ..... C10L 9/08

[52] U.S. Cl. ..... 44/62; 44/311

[58] Field of Search ..... 44/620, 311

[56] References Cited

U.S. PATENT DOCUMENTS 1,750,609 3/1930 Turke ..... 44/620

4,981,667 1/1991 Berg et al. ..... 423/244 A

FOREIGN PATENT DOCUMENTS 9232178A 6/1983 Japan ..... 44/620

0193466 2/1923 United Kingdom ..... 44/620

*Primary Examiner*—Jacqueline Howard

[57] ABSTRACT

A meltable pumpable homogeneous carbonaceous mixture is produced by mixing powdered coal into molten petroleum pitch.

1 Claim, No Drawings

DISSOLUTION OF COAL WITH PETROLEUM PITCH

FIELD OF THE INVENTION

This invention relates to a method or process for the dissolution of coal with petroleum pitch.

DESCRIPTION OF THE PRIOR ART

The high carbon content fuels such as petroleum coal tar pitches as well as coal, are among the cheapest sources of energy. The petroleum or coal tar pitches melt when heated and thus can be employed with burners designed to handle high viscosity liquid fuels. Coal is a non-volatile solid and must be handled as a lump or a powdered solid.

L. Berg & J. W. Berg, U.S. Pat. No. 4,981,667 showed that by adding sufficient calcium oxide or calcium carbonate to react with the sulfur in the coke and pitch, the sulfur in the coke and pitch is converted to calcium sulfate instead of $SO_2$ when burned as a fuel.

OBJECTIVE OF THE INVENTION

The object of this invention is to provide a method or process for converting coal into a carbonaceous liquid which can be pumped and/or burned in a liquid fuel burner.

SUMMARY OF THE INVENTION

The objects of this invention are provided by a process for converting coal into a liquid mixture by the dissolution of powdered coal in petroleum pitch.

DETAILED DESCRIPTION OF THE INVENTION

We have discovered that when powdered coal is mixed into hot petroleum pitch at a temperature above the melting point of the pitch, the coal will dissolve in the pitch producing a single liquid phase mixture. Upon cooling, a homogeneous solid is produced which can be re-melted and/or re-cooled without further change. The uniqueness of this invention is the discovery that a very high carbon content meltable material—pitch—has sufficient solvent power when melted to dissolve coal. The low price of pitch coupled with the possibility of mild process conditions and the resultant low capital cast is the basis for an economical coal dissolution process. Further, a refinery with a propane deasphalter could use our discovery to augment the heating value by the inclusion of the powdered coal.

When sufficient calcium oxide or calcium carbonate to react with the sulfur in the coal and the pitch is added, the sulfur is converted to calcium sulfate instead of sulfur dioxide when this mixture is burned as a fuel.

USEFULNESS OF THE INVENTION

Coal does not melt regardless of how high it is heated and therefore is precluded for use as a liquid fuel. When coal is powdered and mixed with hot petroleum pitch, dissolution of the coal occurs giving a single-phase material which is then a suitable fuel for use with liquid fuel burners.

WORKING EXAMPLES

1. Rosebud Montana sub-bituminous coal was ground into 100–200 mesh particles. Twenty parts by weight of the powdered coal was mixed with 25 parts of petroleum pitch having a melting point of 245° F. and stirred together for ten minutes at 400° F. The coal and the pitch formed a single phase homogeneous mixture. Upon cooling to below 200° F., it became a brittle solid. Upon re-heating, a viscous material of uniform composition was formed.

2. Twelve parts of petroleum pitch, eight parts of sub-bituminous coal and two parts of calcium carbonate were mixed together and allowed to burn in air. The heating value of the mixture was 13,700 Btu/lb. and its sulfur content was 3.9%. The sulfur content of the ash was 7.6%.

We claim:

1. A method for making a meltable uniform carbonaceous mixture from coal, petroleum pitch and calcium oxide or calcium carbonate, which comprises mixing coal particles in the range of 100–200 mesh size with petroleum pitch and sufficient calcium oxide or calcium carbonate to convert the sulfur content of the pitch and the coal to calcium sulfate during burning, and heating said mixture at 300–500° F. for ten to thirty minutes.

* * * * *